US007590365B2

(12) United States Patent
Miyaji et al.

(10) Patent No.: US 7,590,365 B2
(45) Date of Patent: Sep. 15, 2009

(54) IMAGE FORMING APPARATUS WITH CHARGING BIAS CORRECTING PORTION FOR CORRECTING A CHARGING BIAS OF A CHARGING ROLLER

(75) Inventors: Shinki Miyaji, Osaka (JP); Yoshihiko Maruyama, Osaka (JP)

(73) Assignee: Kyocera Mita Corporation (JP)

( * ) Notice: Subject to any disclaimer, the term of this patent is extended or adjusted under 35 U.S.C. 154(b) by 167 days.

(21) Appl. No.: 11/823,793

(22) Filed: Jun. 28, 2007

(65) Prior Publication Data

US 2008/0044194 A1 Feb. 21, 2008

(30) Foreign Application Priority Data

Jun. 29, 2006 (JP) ..... 2006-180192

(51) Int. Cl.
*G03G 15/02* (2006.01)

(52) U.S. Cl. ..... 399/50; 399/176

(58) Field of Classification Search ..... 399/50, 399/48, 66, 174, 176, 168; 358/406, 504; 347/19

See application file for complete search history.

(56) References Cited

U.S. PATENT DOCUMENTS 6,314,251 B1 * 11/2001 Gomi et al. ..... 399/50 X
2005/0271406 A1 * 12/2005 Okano et al. ..... 399/50
2006/0251438 A1 * 11/2006 Uchitani et al. ..... 399/50
2007/0166063 A1 * 7/2007 Kitano ..... 399/50 X
2007/0189790 A1 * 8/2007 Miura et al. ..... 399/50
2008/0003004 A1 * 1/2008 Miyaji et al. ..... 399/50

FOREIGN PATENT DOCUMENTS

JP 2004-205583 7/2004
JP 2004-205583 A * 7/2004

* cited by examiner

*Primary Examiner*—Sophia S Chen
(74) *Attorney, Agent, or Firm*—Gerald E. Hespos; Anthony J. Casella

(57) ABSTRACT

An image forming apparatus uses a charging roller to charge the surface of a photosensitive member to a predetermined potential. A current detector detects charging current when the charging bias is applied. A bias corrector corrects the charging bias and a storage stores a target charging current value when the photosensitive member is charged to a required potential. The bias corrector performs two corrections. The first correction compares a charging current value with a stored target charging current value, and determines a new bias based on the comparison. The second correction determines whether the bias obtained by the first correction is at a predetermined level or a higher level, and when the corrected charging bias is at the higher level, changes the target charging current value in accordance with the corrected charging bias and obtains a new charging bias on the basis of the changed target charging current value.

4 Claims, 6 Drawing Sheets

IMAGE FORMING APPARATUS WITH CHARGING BIAS CORRECTING PORTION FOR CORRECTING A CHARGING BIAS OF A CHARGING ROLLER

BACKGROUND OF THE INVENTION

1. Field of the Invention

The present invention relates to an image forming apparatus that has a function which charges a photosensitive member surface using a charging roller. More particularly, the present invention relates to an image forming apparatus in which correction of a charging bias is possible.

2. Description of the Related Art

In recent years, a charging roller system that has a characteristic of suppressing ozone generation has been widely adopted as a charging mechanism of image forming apparatuses that use an electrophotographic method. For this charging roller, since a resistance value changes depending on the environment or life, a method has been proposed that determines an output bias based on a result obtained by detecting the charging current in order to apply the optimal bias in accordance with the change in resistance of the charging roller.

However, there is a problem that it is extremely difficult to accurately detect the charging current. The reason is that since, in particular, a current (charging current) in a charging roller in which the resistance value has increased changes accompanying the passage of time immediately after application of a bias (charging bias), the detection result will be different depending on the timing at which the current is detected. In the worst case an appropriate bias can not be output.

To solve this problem, for example, Japanese Patent Laid-Open No. 2004-205583 discloses a method which repeats detection of a current flowing in a charging member a plurality of times when applying a bias, and then starts an image forming operation when the variation amount from the time of the previous detection is lower than a certain threshold value. However, according to this method there is a problem that, in a case in which the resistance value of the charging roller increases to a large degree, time is required until the aforementioned variation amount becomes less than the threshold value, i.e. until the resistance value is stable, and thus the time until an image forming operation starts (so-called "aging time") is extremely long. In contrast, in the latter half of the life of a charging roller, the relation between the charging current and the surface potential of the photosensitive drum changes from the relation in the first half of the life of the charging roller, and there is a problem that the bias cannot be properly corrected. This phenomenon can be explained as followed. That is, since the resistance value of a charging roller gradually increases together with the usage amount (life) thereof, it is necessary to increase the applied bias in accordance therewith. However, as the usage proceeds and the latter half of the life of the charging roller is entered, the bias value becomes a large value that exceeds a certain value and leakage current to the photosensitive drum starts to occur (however, this does not occur to a degree that imparts a physical defect to the photosensitive drum). If this situation occurs, even if the charging current flows well, the surface potential of the photosensitive drum itself does not rise very much. Therefore, even if the charging current is detected to perform bias correction, the required surface potential can not be obtained.

SUMMARY OF THE INVENTION

An object of the present invention is to provide an image forming apparatus that can output the appropriate charging bias even when the resistance value or the like of a charging roller changes.

According to one aspect of the present invention there is provided an image forming apparatus that charges a surface of a photosensitive member to a predetermined potential using a charging roller, comprising: a bias applying portion that applies a charging bias to the charging roller; a current detecting portion that detects a charging current when the charging bias is applied; a bias correcting portion that carries out correction of the charging bias; and a target information storing portion that stores a target charging current value that is taken as a target, that is a charging current value when the surface of the photosensitive member is charged to a required surface potential, characterized in that the bias correcting portion performs a first bias correction operation and a second bias correction operation, in which, the first bias correction operation is an operation that compares a charging current value that is detected by the current detecting portion when a predetermined charging bias is applied by the bias applying portion with a target charging current value that is stored in the target information storing portion, and determines a new charging bias by correcting the predetermined charging bias on the basis of the comparison result; and the second bias correction operation is an operation that determines whether a corrected charging bias that is obtained as a result of the first bias correction operation is at a predetermined first level or at a second level that is higher than the first level, and when the corrected charging bias is determined to be at the second level, changes the target charging current value in accordance with the corrected charging bias and obtains a new charging bias by correcting the corrected charging bias on the basis of the target charging current value that is changed.

DETAILED DESCRIPTION OF THE PREFERRED EMBODIMENTS

Figure 1:
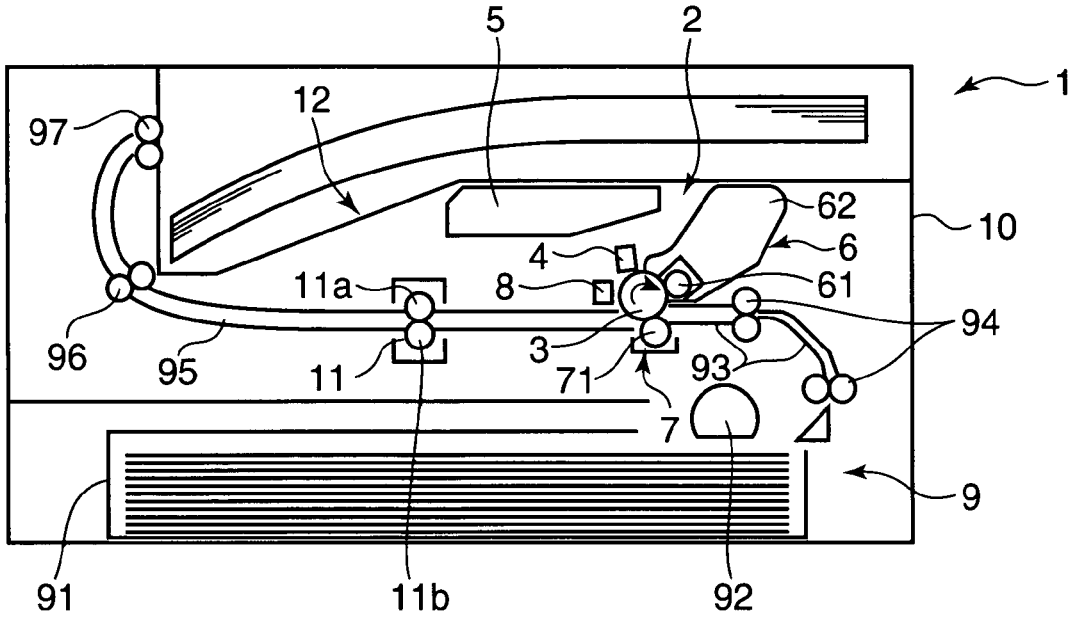
FIG. 1 is a sectional view that schematically shows the internal configuration of an image forming apparatus (printer) according to an embodiment of the present invention.

FIG. 1 is a sectional view that schematically shows the internal configuration of an image forming apparatus according to an embodiment of the present invention. The image forming apparatus according to the present invention is a multifunction device, a printer, a facsimile machine or the like that develops an electrostatic latent image using toner by an electrophotographic method. In the present embodiment, a printer 1 is described as an example of the image forming apparatus. In the printer 1, an image forming portion 2 is provided inside a printer main unit 10. As shown in FIG. 1, the image forming portion 2 performs image formation on a sheet, and includes a photosensitive drum 3, and a charging portion 4, an exposing portion 5, a developing portion 6, a transferring portion 7, and a cleaning portion 8 that are disposed around the photosensitive drum 3.

Figure 2:
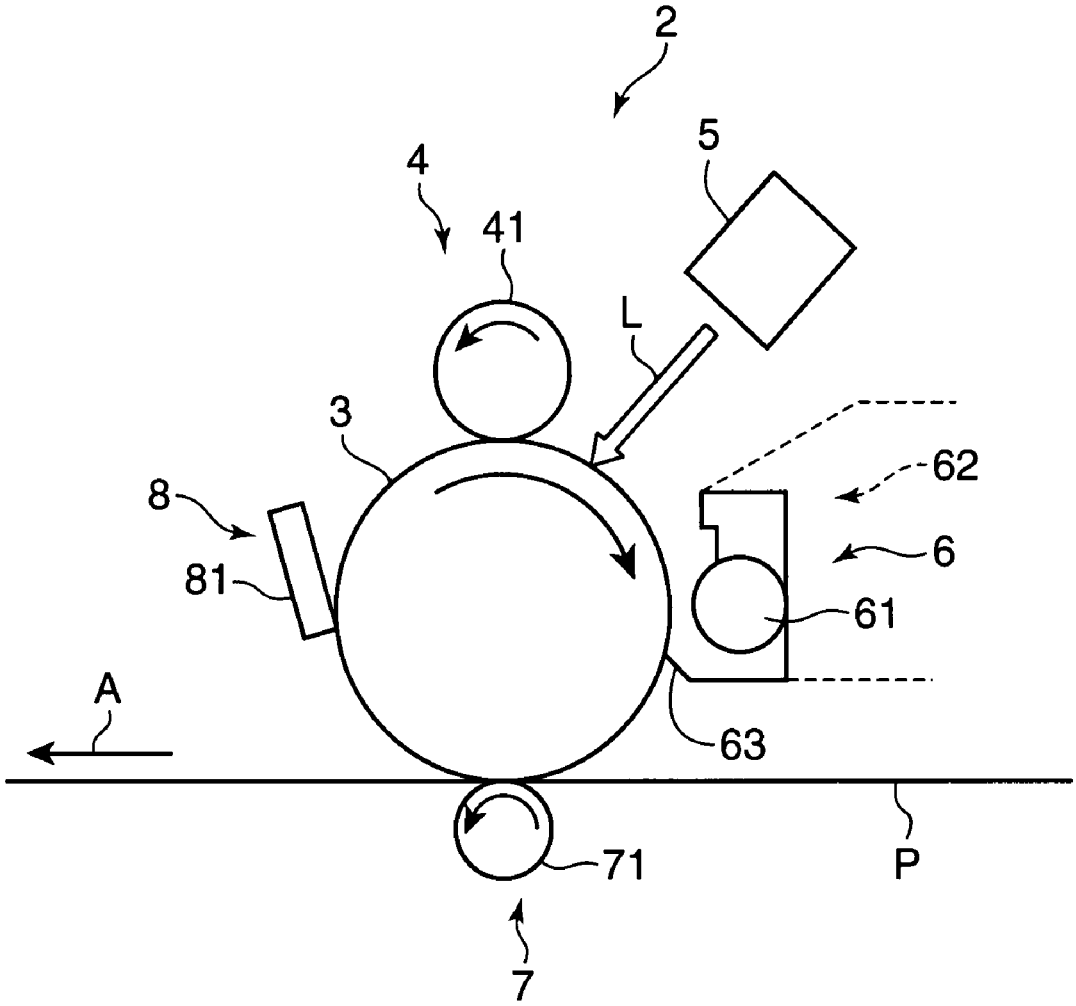
FIG. 2 is a partial enlarged view that schematically shows an image forming portion of the printer shown in FIG. 1.

FIG. 2 is a partial enlarged view that schematically shows the image forming portion 2. The photosensitive drum 3 is an image bearing member that is supported such that it can rotate in the direction indicated by the arrow in the figure. In this case, a photosensitive drum comprising amorphous silicon (a-Si) is used. This a-Si drum is obtained by forming a film of amorphous silicon on the surface of a predetermined drum-shaped member (cylindrical member) by deposition, for example. The amorphous silicon film has a characteristic that the degree of hardness on the film surface is extremely high, and thus the durability (environmental resistance) of the photosensitive member is high. In this case, a member with a drum diameter of approximately 30 mm and which rotates at a speed (linear speed; rotational circumferential speed) of approximately 310 mm/sec is employed as the photosensitive drum 3.

The charging portion 4 uniformly charges the surface of the photosensitive drum 3 (drum surface) to a predetermined potential, for example, approximately +250V. The charging portion 4 includes a charging roller 41 that is disposed facing the photosensitive drum 3, and performs charging in a state in which the charging roller 41 is pressed against the photosensitive drum 3. The charging roller 41 is, for example, a member on which a resilient layer comprising an ion conductive material (a material having semiconductor properties) such as epichlorohydrin rubber is formed on a predetermined core metal so that the diameter of the roller is about 12 mm, for example. The surface roughness Rz of the epichlorohydrin rubber is taken to be, for example, approximately 10 μm.

Normally, since an ion conductive material is used as described above in the charging roller 41, the resistance value thereof varies according to the environment (temperature and humidity) as well as the life (elapsed time) of the charging roller 41. In particular, as usage of the charging roller 41 proceeds (total usage time becomes long), the resistance value thereof also becomes high, and when the charging roller 41 enters the latter half of its life, it reaches a point at which a situation occurs in which even when a predetermined charging current is flowed, the surface potential does not increase to a surface potential level that should be obtained in response to the predetermined charging current. Consequently, in the latter half of the life of the charging roller 41, even if a charging current is detected and bias correction is performed based on the charging current it is no longer possible to charge the drum surface to the required surface potential. Therefore, according to the present embodiment a configuration is adopted that corrects a charging bias (Vdc) so that a required surface potential can be obtained by taking into variations in the resistance value of the charging roller 41 and the problem when usage of the charging roller 41 has proceeded (in the latter half of the life of the charging roller 41). This correction of the charging bias is described in detail later.

The exposing portion 5 is a so-called "laser scanner unit" that exposes the photosensitive drum 3 with a laser beam. The exposing portion 5 forms an electrostatic latent image on the drum surface by irradiating a laser beam L that is output from a laser diode on the basis of image data that is sent from a image data storing portion 40, described later, or the like onto the drum surface. In this connection, the exposing portion 5 shown in FIG. 2 is a simplified illustration of the exposing portion 5 shown in FIG. 1.

The developing portion 6 is a member that causes toner to adhere to the electrostatic latent image formed on the drum surface to visualize an image. The developing portion 6 includes a developing roller 61 that is disposed facing the photosensitive drum 3 in a non-contacting condition, a toner containing portion 62 that contains toner, and a regulating blade 63 (ear cutting plate) and the like. The regulating blade 63 regulates so that a toner amount that is supplied from the toner containing portion 62 to the developing roller 61 is the appropriate amount. More specifically, the regulating blade 63 cuts off the "ears" of toner, i.e. regulates the thickness of the toner, that is adhered in a so-called "ear-up state" (state of the magnetic brush) on the surface of a sleeve (omitted from the drawings) of the developing roller 61 to uniformly adjust the adherence amount. A thin layer of toner having substantially the same thickness is thus formed on the sleeve by this adjustment of the adherence amount.

The transferring portion 7 transfers a toner image onto a sheet. More specifically, the transferring portion 7 includes a transfer roller 71 that is disposed facing the photosensitive drum 3, and transfers a toner image that is visualized on the drum surface onto a sheet P (transfer material) that is conveyed in the arrow direction indicated by the reference character A in a state in which the sheet P is pressed against the photosensitive drum 3 by the transfer roller 71.

The cleaning portion 8 includes a cleaning blade 81 and the like, and cleans toner (transfer residual toner) that remains on the drum surface after transfer by the above described transferring portion 7 is completed. The cleaning blade 81 is configured such that, for example, an end thereof is pressed into contact with the drum surface to thereby mechanically remove residual toner on the drum surface. In this connection, a charge eliminating portion (erasing light source) (omitted from the figures) that eliminates a charge, that is, eliminates a residual potential (charge), on the photosensitive member surface using a charge eliminating light beam may also be provided in the cleaning portion 8 or the like.

The printer 1 also includes a feeding portion 9 that feeds paper in the direction of the image forming portion 2 (photosensitive drum 3) and a fixing portion 11 that fixes toner image that is transferred onto a sheet.

The feeding portion 9 includes a sheet cassette 91 that stores paper of each size, a pick-up roller 92 for taking out the stored paper, a conveying path 93 that is a path on which a sheet is conveyed, and conveying rollers 94 that perform conveying of a sheet in the conveying path 93 and the like. The feeding portion 9 conveys sheets that are sent forward one at a time from the sheet cassette 91 towards a nip portion between the transfer roller 71 and the photosensitive drum 3. The feeding portion 9 conveys a sheet onto which a toner image is transferred (the aforementioned sheet P) to the fixing portion 11 via the conveying path 95, and also conveys a sheet that undergoes fixing processing at the fixing portion 11 as far as a sheet discharge tray 12 that is provided at the top portion of the printer main unit 10 using conveying rollers 96 and discharge rollers 97.

The fixing portion 11 comprises a heat roller 11*a* and a pressure roller 11*b*. The fixing portion 11 melts toner on a sheet using heat of the heat roller 11*a* to fix a toner image onto the sheet by applying pressure using the pressure roller 11*b*.

Figure 3:
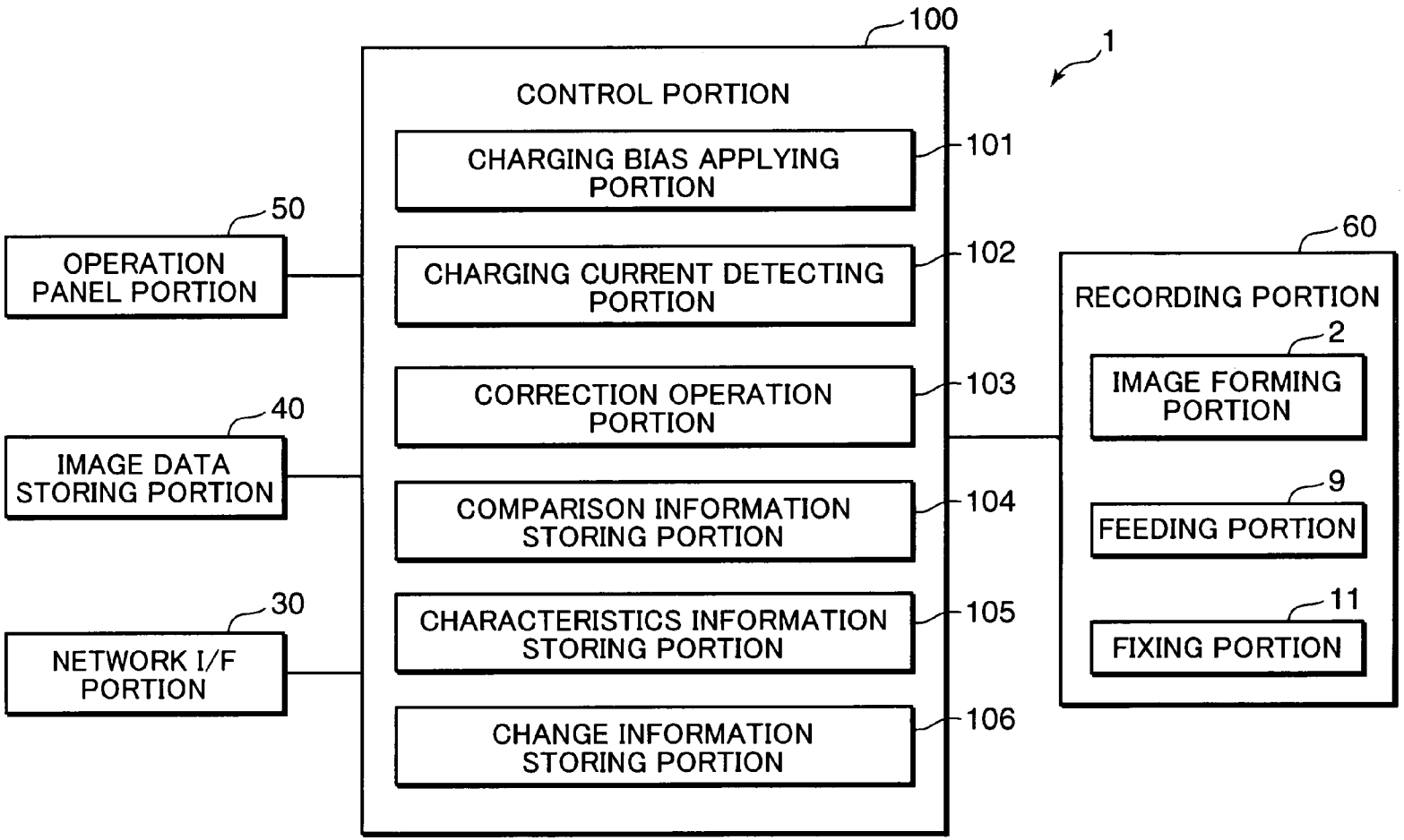
FIG. 3 is a block diagram showing one example of the electrical configuration of the printer shown in FIG. 1.

FIG. 3 is a block diagram showing one example of the electrical configuration of the printer 1. As shown in the figure, the printer 1 includes a network I/F (interface) portion 30, an image data storing portion 40, an operation panel portion 50, a recording portion 60, a control portion 100 and the like. The network I/F portion 30 controls sending and receiving of various kinds of data between the printer 1 and an information processing apparatus (external apparatus) such as a PC that is connected through a network such as a LAN. The image data storing portion 40 temporarily stores image data that is sent from a PC or the like through the network I/F portion 30. The operation panel portion 50 is provided at the front portion or the like of the printer 1, and is a part that functions as entry keys through which various kinds of instruction information (commands) from a user is input, or display predetermined information. The recording portion 60 comprises the image forming portion 2, the feeding portion 9 and the fixing portion 11 as described above, and performs recording (printing) of image information onto a sheet based on image data that is stored in the image data storing portion 40 or the like.

The control portion 100 comprises a ROM (Read Only Memory) that stores control programs and the like of the printer 1, a RAM (Random Access Memory) that temporarily holds data, and a microcomputer that reads out and executes the aforementioned control programs and the like from the ROM. The control portion 100 performs control of the apparatus overall in accordance with predetermined instruction information that is input at the operation panel portion 50 and the like or detection signals from the various sensors provided at respective positions in the printer 1. The control portion 100 includes a charging bias applying portion 101, a charging current detecting portion 102, a correction operation portion 103, a comparison information storing portion 104, a characteristics information storing portion 105, and a change information storing portion 106.

The charging bias applying portion 101 is a portion that applies a charging bias Vdc (performs charging bias application control) to the charging roller 41. The symbol Vdc indicates the direct current (DC) component of a charge voltage. The charging bias Vdc may be only the DC component or may be a value obtained by superimposing an alternating current (AC) component thereon. However, the charge potential itself of the drum surface is determined by the bias Vdc of the direct current component (DC bias).

The charging current detecting portion 102 detects a charging current (DC current) Idc when a charging bias Vdc is applied to the charging roller 41 by the charging bias applying portion 101. This charging current Idc may be detected on the charging roller 41 side, more specifically, for example, a charging current flowing in the charging roller 41 may be detected, or may be detected on the photosensitive drum 3 side, more specifically, for example, a charging current that flows to the drum surface from the charging roller 41 may be detected. In this connection, the reasons for detecting the charging current without directly detecting the surface potential of the photosensitive drum 3 in this manner is that means that measures the surface potential generally results in increased costs and, furthermore, space is required to dispose means that measures the surface potential and the size of the apparatus is consequently increased. Detecting the charging current without directly detecting the surface potential of the photosensitive drum 3 makes it possible to avoid this kind of increase in costs and increase in size.

The correction operation portion 103 performs correcting operations (bias correction processing) that correct the charging bias Vdc. The correction operation portion 103 performs a first bias correction operation and a second bias correction operation as described below.

<First Bias Correction Operation>

As a first bias correction operation the correction operation portion 103 uses information relating to a charging current Idc that is detected by the charging current detecting portion 102 when a charging bias as an initial setting is applied to the charging roller 41 by the charging bias applying portion 101, and a target current Idc(T) that is described later to perform an operation to compare the charging current Idc and the target current Idc(T). Subsequently, the correction operation portion 103 calculates a new charging bias, that is, a corrected charging bias in which the charging bias is corrected, by adding (on) a bias correction value that is obtained by multiplying a difference between the current value (current value Idc) of the charging current Idc and the current value (current value Idc(T)) of the target current Idc(T) by a correction coefficient k (the correction coefficient "k" is described later) to the charging bias Vdc of the aforementioned initial setting. The correction operation 4 portion 103 outputs the information of the corrected charging bias to the charging bias applying portion 101.

Although according to the present embodiment a configuration is adopted, as shown in a flowchart described later, in which the correction operation portion 103 repeats the above described operation once only, the operation may be repeated a plurality of time (the greater the number of repetitions, the higher the correction accuracy). However, since the time until the start of an image forming operation will be long if the number of repetitions is excessively large, when repeating the operation a plurality of times it is desirable to set the number of repetitions to a predetermined appropriate number, for example, about two or three repetitions. This number of repetitions may be a number that is set as a predetermined value (fixed value) or, for example, may be a number that is decided so that the repetition operation finishes when the level of change caused by correction of the charging bias (for example, the difference between the charging bias before correction and after correction) reaches a predetermined level (in this case also, a predetermined level is set such that the repetition operation finishes at a number at which the number of repetitions does not become large).

A second operation with respect to the above described first operation will now be specifically described for a case in which this kind of operation is repeated a plurality of times. In this case, the correction operation portion 103 detects a charging current Idc that is detected by the charging current detecting portion 102 when the corrected charging bias that is obtained by the first operation is applied to the charging roller 41 by the charging bias applying portion 101 and, similarly to the case described above, adds a bias correction value that is obtained by multiplying a difference between the detected charging current Idc and the target current Idc(T) by the correction coefficient k to the corrected charging bias to calculate a new charging bias (information regarding this corrected charging bias is likewise also output to the charging bias applying portion 101). Thus, the correction operation portion 103 performs an operation that repeats a required number of times the routine of determining a correction value (bias correction value) based on a charging current value (Idc) and a comparison value (Idc(T)), setting a new charging bias by correcting the charging bias using this correction value, and outputting the charging bias to the charging bias applying portion 101.

It can be said that the relevant repetition operation is an operation that determines an $n^{th}+1$ charging bias by adding an $n^{th}$ bias correction value that is calculated by the following formula (1) to an $n^{th}$ charging bias.

$$(Idc(T)-Idc(n))*k \quad (1)$$

Wherein, the symbol "*" represents multiplication (the same applies hereafter), "n" represents the $n^{th}$ time of a number of repetitions (n is a natural number), and Idc(n) represents the $n^{th}$ charging current. The symbol "k" is the above described correction coefficient.

In this connection, the information of the charging bias as the initial setting described above is stored, for example, in the correction operation portion 103 or the charging bias applying portion 101. Further, the information of the correction coefficient k described above is stored, for example, in the correction operation portion 103. Furthermore, although in the above description a bias correction value is "added" to the charging bias to obtain a new charging bias, the meaning of "subtraction" (i.e. addition of a negative value) is also included in the term "added". In actuality, since the charging bias decreases, the bias correction value is raised to correct the decreased amount. Furthermore, the bias correction value may be determined on the basis of a formula other than formula (1), and may be determined by data conversion using a predetermined conversion table. A calculation method that corrects a charging bias using the relevant bias correction value may also be a method other than the above described addition or subtraction (for example, multiplication or division).

<Second Bias Correction Operation>

As the second bias correction operation, when a voltage value of a charging bias after the above described first bias correction operation is a value that is equal to or greater than a certain inflection starting voltage in the charging bias-charging current characteristics (Vdc-Idc characteristics), the correction operation portion 103 performs correction of the target current Idc(T) that is used in the aforementioned first bias correction operation, and corrects (re-corrects) the charging bias using this corrected target current Idcα(T). This correction is described in detail below.

Figure 5:
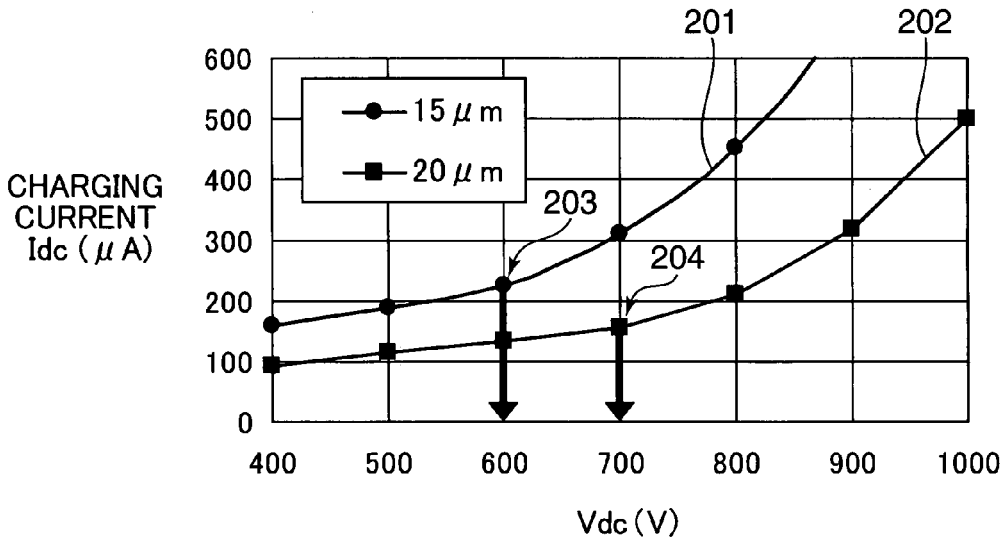
FIG. 5 is a graph diagram showing an example of Vdc-Idc characteristics that have a relationship between a charging bias Vdc and a charging current Idc.

FIG. 5 is a view showing an example of the above described Vdc-Idc characteristics showing the relationship between the charging bias Vdc and the charging current Idc, in which the vertical axis in the graph represents the charging current Idc (μA) and the horizontal axis represents the charging bias Vdc (V). The Vdc-Idc characteristics are characteristics which are determined by the initial film thickness of the photosensitive drum 3 (photosensitive member). In this case, the respective Vdc-Idc characteristics 201 and 202 for an a-Si drum for which the initial film thickness is, for example, approximately 15 μm or approximately 20 μm are shown. As shown in FIG. 5, with respect to the Vdc-Idc characteristics 201 and 202, the characteristics graph inflects (bends) when the value of the charging bias Vdc (voltage value) reaches a certain value or greater. In other words, for the Vdc-Idc characteristics 201 and 202, the slopes of the graphs increase in a so-called exponential manner from around the positions of the points indicated by reference numeral 203 and reference numeral 204 (referred to as "inflection points 203 and 204") A voltage value (charging bias Vdc) at which the graph starts to inflect at the inflection point 203 or 204 is referred to as an "inflection starting voltage". In this connection, the range of a voltage level that is less than the voltage value at an inflection point is taken as a first level, and the range of a voltage level that is equal to or greater than the inflection point as a level that is higher than the first level is taken as a second level.

For example, in a case using an a-Si drum with a film thickness of 15 μm, that is, in the case of the Vdc-Idc characteristic 201, the inflection starting voltage is, for example, approximately 600 V, and the slope of the characteristic starts to change when the charging bias Vdc exceeds 600 V (although the characteristic changes somewhat until 600 V, this change is treated as an error). Upon entering a region in which the characteristics change in this manner, a charging current value corresponding to a charging bias of a certain size becomes a value that is larger than a value estimated based on the relation between the charging bias and the charging current up to that point. In other words, at a charging current value that has been set to approach the value of a target current Idc(T) set as a target up to that time, a charging bias value is obtained that is lower than a charging bias value that should be obtained in correspondence with the charging current value (target current value). Thus, in a case where the charging bias becomes a value that is equal to or greater than an inflection point (in this case equal to or greater than 600 V) of the Vdc-Idc characteristic, it is necessary to change the value of the target current Idc(T), more specifically, to raise the value of the target current Idc (T). In this sense, it can be said that the inflection starting voltage in question is a charging bias value that acts as a so-called "trigger" for changing (correcting) the target current Idc(T).

In this connection, the above described inflection starting voltage increases together with an increase in the thickness of the film. Strictly speaking, a-Si consists of multiple layers, and since the thickness of each layer influences the inflection starting voltage, respectively, the greater the number of layers, the higher the inflection starting voltage becomes. Accordingly, as shown in FIG. 5, for the Vdc-Idc characteristic 202 where the film thickness is 20 μm that is thicker than 15 μm, the inflection starting voltage is, for example, 700 V, which is greater than 600 V.

In consideration of the above described situation, when a charging bias after the first bias correction operation (hereunder, referred to as appropriate as "charging bias after correction") is greater than or equal to the inflection starting voltage, the correction operation portion 103 changes the value of the target current Idc(T) in accordance with the size of the charging bias and performs bias correction of the charging bias using the changed target current Idc(T). The actual operation is as follows. First, the correction operation portion 103 uses the aforementioned Vdc-Idc characteristics information to determine whether a charging bias (for example, Vdc(B) described later) that was calculated by the first bias correction operation is at the above described first level or second level. That is, the correction operation portion 103 determines whether or not the charging bias Vdc(B) is a voltage value that is greater than or equal to (or less than) the inflection starting voltage. If the charging bias Vdc(B) is a voltage value (second level) that is greater than or equal to the inflection starting voltage, the correction operation portion 103 uses, for example, change information shown in FIG. 6, described below, to change the value of the current target current Idc(T) to a charging current value corresponding to the charging bias after correction to set a new target current Idcα(T). Then, the charging bias is re-corrected based on the target current Idcα(T). This re-correction of the charging bias is performed, for example, by determining a new charging bias by calculating a further bias correction value based on formula (2) below that conforms to a formula in which the first item "Idc(T)" in the above formula (1) is replaced with "Idcα(T)", and adding this bias correction value to a charging bias after the correction.

$$(Idc\alpha(T)-Idc(m))*k \quad (2)$$

Wherein, Idc(m) represents a charging current value that is detected when a corrected charging bias Vdc that is obtained after performing the $m^{th}$ repetition operation in the first bias correction operation is applied. According to the present embodiment, Idc(m) is a charging current value (Idc(B) that is described later) that is detected at a time of application using a charging bias (Vdc(B) that is described later) obtained in a case in which a repetition operation is executed only one time (m=1) (only the first repetition operation is executed).

Figure 6:
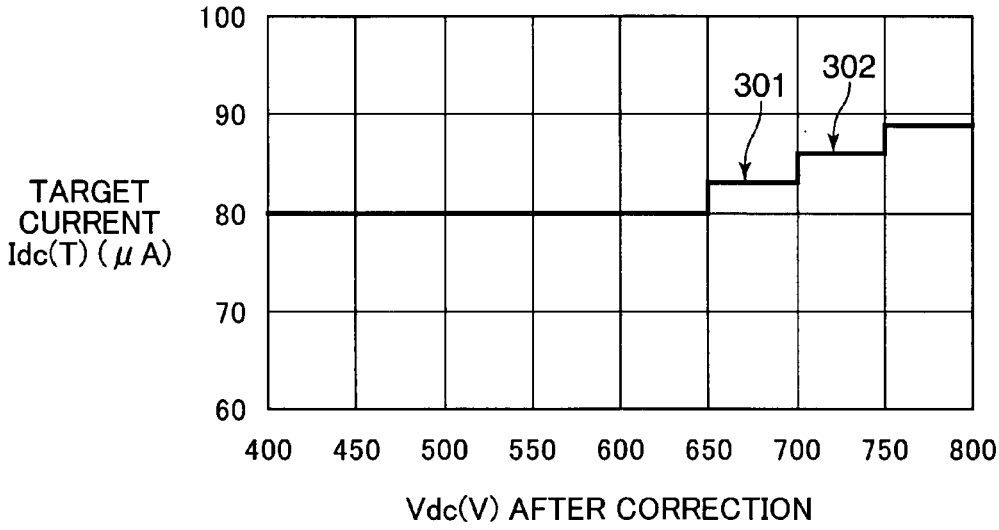
FIG. 6 is a graph diagram showing an example of change information (conversion characteristics) that has a relation between a charging bias Vdc and a target current Idc(T).

FIG. 6 is a graph that shows change information used when changing the current target current Idc(T) to a new target current Idcα(T) in accordance with a charging bias after correction Vdc. This change information includes the correlation between the charging bias after correction Vdc and the target current Idc(T) (corresponds to target current Idcα(T)). This change information corresponds in this case to a case using the above described Vdc-Idc characteristics 201 and, for example, is information represented by a conversion characteristics graph in which the vertical axis is the target current Idc(T) (μA) and the horizontal axis is the charging bias after correction Vdc(V) In this conversion characteristics graph the target current Idc(T) increases in a so-called stepwise manner (staircase pattern) with respect to the charging bias after correction Vdc(V). When the value of the charging bias after correction Vdc(V) is a value that is greater than the inflection starting voltage 600 V, for example, 670 V (a value greater than 650 V and less than 700 V), the correction operation portion 103 changes the current target current value of, for example, 80 μA to a target current value at the level indicated by reference numeral 301. Further, if the charging bias after correction Vdc(V) is, for example, 730 V (value greater than 700 V and less than 750 V), the correction operation portion 103 changes the current target current value to a target current value at the level indicated by reference numeral 302 that is higher than the level indicated by reference numeral 301. Thereafter, the target current value is changed in a similar manner in accordance with the charging bias after correction Vdc(V).

Although in the example illustrated in FIG. 6 a configuration is adopted in which the level of the target current value is not immediately changed even when it is determined that the value of the charging bias after correction Vdc(V) is greater than or equal to 600 V and the current target current value of 80 μA is maintained until 650V, a configuration may also be adopted in which the level of the target current value is immediately changed when the charging bias after correction Vdc (V) becomes 600 V or more, i.e. at the time when the charging bias after correction Vdc(V) reaches 600 V.

Further, the present invention is not limited thereto, and the number of kinds of levels to which the target current value is changed, i.e. the number of steps in the conversion characteristics graph, may be more than or less than the number of steps shown in FIG. 6. A configuration may also be adopted in which the range of increase or the rate of increase in the target current value for the relevant change is fixed, as shown in FIG. 6, or is not fixed, more specifically, for example, a configuration in which the range of increase in the target current value increases together with an increase in the value of the charging bias after correction Vdc(V). Furthermore, regarding the increase in the target current value, the target current value may be increased digitally (stepwise) as shown in FIG. 6 or may be increased in an analog manner (linearly). That is, various kinds of change information (conversion characteristics graphs) can be employed as long as it is possible to change the target current Idc(T) in accordance with the charging bias after correction Vdc(V).

Figure 7:
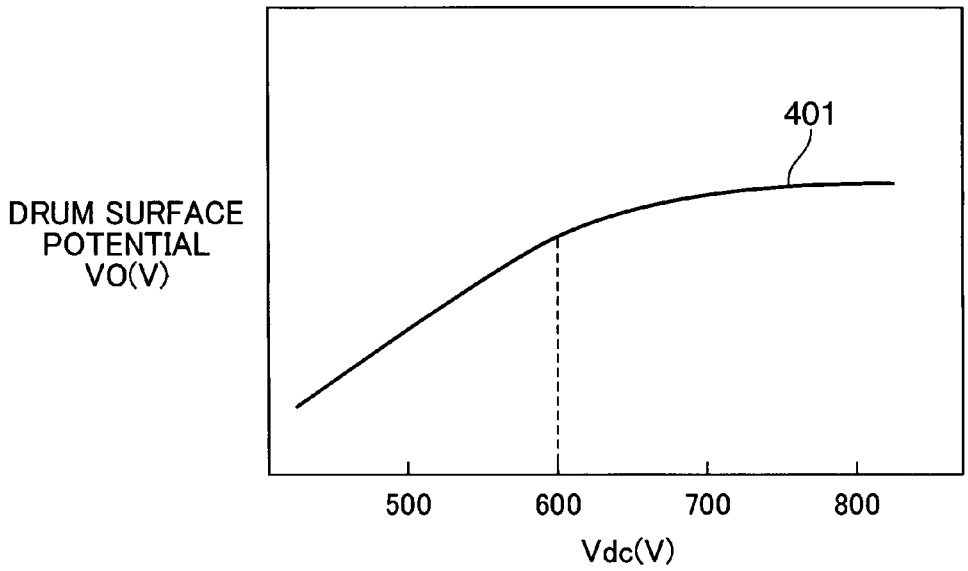
FIG. 7 is a graph diagram showing an example of Vdc-VO characteristics that have the relationship between the charging bias Vdc and a drum surface potential VO.

In this connection, when deciding whether or not to change the target current Idc(T), charging bias-surface potential characteristics (Vdc-VO characteristics 401) that show the relation between the charging bias Vdc(V) and the drum surface potential VO(V) as shown in FIG. 7 may be used in place of the Vdc-Idc characteristics shown in FIG. 5. In this case, with respect to the Vdc-VO characteristics 401, a configuration may also be adopted such that changing of the target current Idc(T) is performed when the proportionality between the charging bias Vdc and the drum surface potential VO begins to fail, for example, at a condition where the charging bias Vdc is equal to or greater than 600 V. In this connection, in this case the point at the voltage value of 600 V in the Vdc-VO characteristics 401 corresponds to the above described inflection point, and the voltage value of 600 V corresponds to the above described inflection starting voltage. In the case of the Vdc-VO characteristics 401 also, the range of voltage values less than the voltage value at this inflection point corresponds to the above described first level, and the range of voltage values equal to or greater than the inflection point to the second level.

The comparison information storing portion 104 stores information (a comparison value) that is compared with a charging current obtained when a charging bias is applied. This comparison information is information regarding the target current Idc(T) as a so-called "target value" at a time when a normal surface potential (the above mentioned +250 V) is on the drum surface, i.e. when the drum surface is charged to a required surface potential, that is previously determined by measuring or the like.

Strictly speaking, since the charging current-charging voltage characteristics (I-V characteristics) of a photosensitive member differ for each photosensitive drum, it is desirable to store the target current Idc(T) that is measured, respectively, for the photosensitive drum of each printer when manufacturing the machine. Further, in fact, not only is the information of the target current Idc(T) stored, but information of a voltage value for charging to a normal surface potential (the above mentioned +250 V) is also stored together with the target current Idc(T).

The characteristics information storing portion 105 stores Vdc-Idc characteristics as shown in the above described FIG. 5 and Vdc-VO characteristics as shown in the above described FIG. 7. The change information storing portion 106 stores change information (conversion characteristics) as shown in the above described FIG. 6. The information that is stored in the characteristics information storing portion 105 and the change information storing portion 106 is read out and used as appropriate in the second bias correction operation by the correction operation portion 103.

The correction coefficient "k" that is described above in relation to the first bias correction operation by the correction operation portion 103 will now be described. The value of the correction coefficient k is a numerical value derived, for example, from the following equation (1.1).

$$\Delta V=(\Delta Q*d)/(\in*\in_0*\Delta S) \quad (1.1)$$

Wherein, the symbol "/" represents division (the same applies hereunder).

Further, "ΔV" represents surface potential variation amount, "ΔQ" represents charge variation amount (i.e. ΔQ indicates current amount), "d" represents photosensitive member thickness (film thickness of photosensitive member), "S" represents charge area, "∈" represents the dielectric constant of the photosensitive member, and $\in_0$ represents the dielectric constant of a vacuum.

Provided, the above described equation (1.1) is derived from equation (1.3) as a modified equation of equation (1.2) as shown below.

$$Q=C*V=\in*\in_0*(S/d)*V \quad (1.2)$$

$$V=(Q*d)/(\in*\in_0*S) \quad (1.3)$$

In this case, taking the example of a printer with a certain function (for example, a printer that prints 45 sheets per minute machine), for example, when the values ΔQ=1, d=16 μm, S=(220*307) $mm^2$, and each dielectric constant are substituted into the above equation (1.1), ΔV≈2. Provided, for S, the numerical value 220 represents the effective charging width of 220 mm of a charging roller and the numerical value 307 represents the speed of 307 mm/sec (moving distance of the photosensitive member in one second) for the 45 sheets per minute machine in question.

From the relevant substitution result, it is found that the surface potential changes approximately 2 V per 1 μA of current. Accordingly when (Idc(T)−Idc(n))*k of the above described formula (1) is considered, with respect to a 45 sheets per minute machine, if the detected charging current (Idc(n)) is, for example, 75 μA and, for example, it represents a drop of 5 μA in comparison with a target current Idc(T) of 80 μA (Idc(T)−Idc(n)=5 μA), the surface potential of the photosensitive member will decrease by 5*2=10 V, and it is thus necessary to correct this 10 V amount.

In the case of a different, for example, 30 sheet per minute machine for which the linear speed is 178 mm/sec, when the value are substituted in a similar manner into the above equation (1.1), it is found that ΔV≈4, and the surface potential of the photosensitive member drops by 5*4=20 V, and it is thus necessary to correct this 20 V amount. That is, the correction coefficient k is the value ΔV indicated in the above described equation (1.1) (k=ΔV), and that unit is (V/μA) in the present embodiment. Further, k is a value that changes depending on the moving speed (linear speed) of the photosensitive member.

Figure 4:
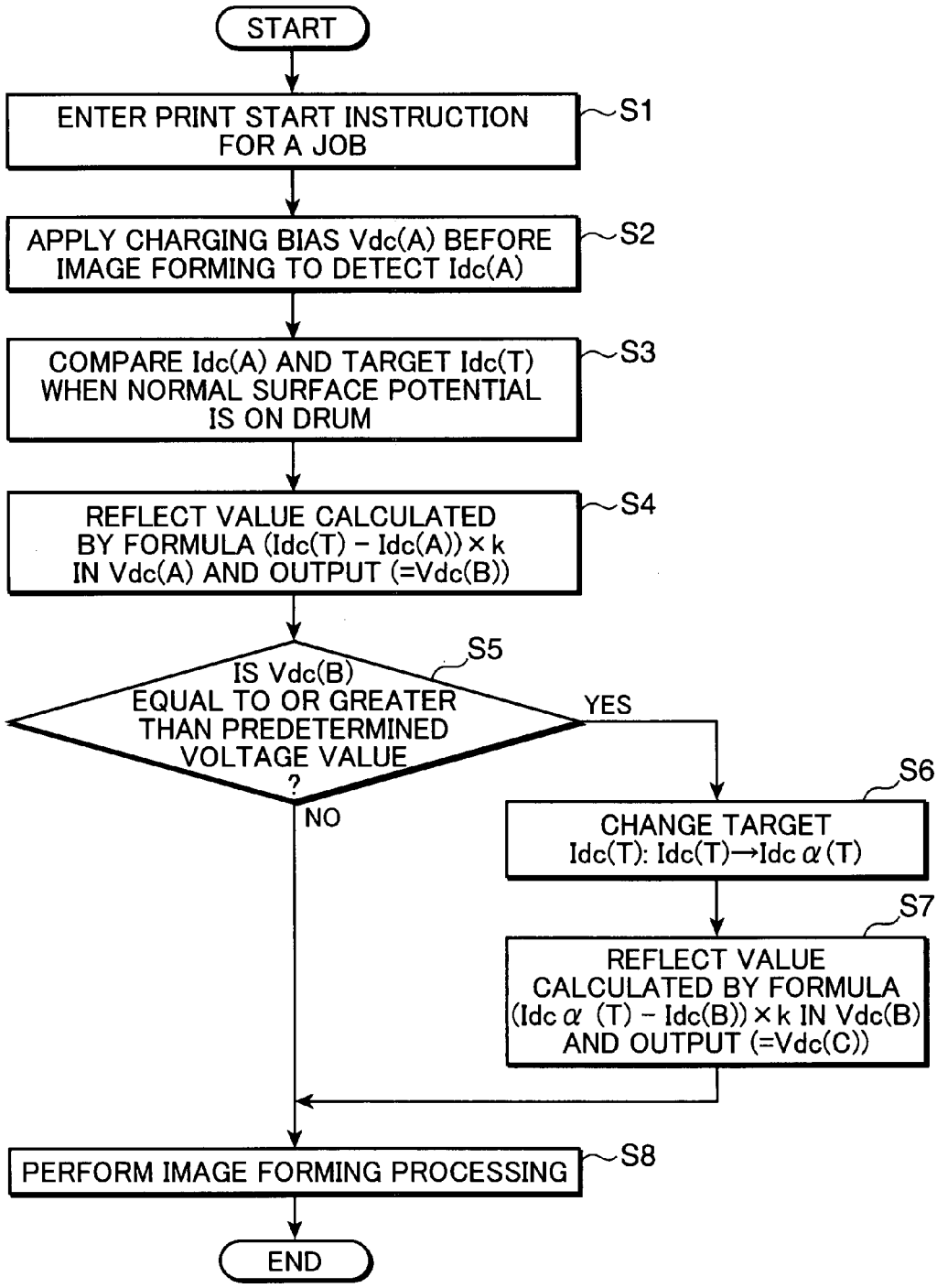
FIG. 4 is a flowchart relating to one example of an operation to correct a charging bias according to the present embodiment.

FIG. 4 is a flowchart relating to one example of an operation to correct a charging bias according to the present embodiment. First, for example, a print start instruction is made for a certain print job by the user inputting an instruction from the operation panel portion 50 or the like (step S1). Before performing the actual image forming operation for this print job, the charging bias applying portion 101 applies a charging bias Vdc(A) to the charging roller 41. Further, the charging current detecting portion 102 detects a charging current Idc(A) when the charging bias Vdc(A) is applied (step S2). However, this charging bias Vdc(A) is a charging bias as the initial setting value.

Next, the correction operation portion 103 compares the charging current Idc(A) that is detected in the above described step S2 with the target current Idc(T) that is previously stored in the comparison information storing portion 104. More specifically, the correction operation portion 103 subtracts Idc(A) from Idc(T) to determine the difference in these current values (step S3). The correction operation portion 103 then calculates a bias correction value using the formula (Idc(T)−Idc(A))*k (corresponds to the case of n=1 in the above described formula (1)), adds (reflects) this calculated bias correction value to the above described charging bias Vdc(A) to calculate a charging bias Vdc(B), and outputs this charging bias Vdc(B) information to the charging bias applying portion 101 (step S4). According to the present embodiment, this charging bias Vdc(B) is obtained as the result of a first bias correction operation in which a repetition operation is executed only once (only the first repetition operation is performed).

Next, as the second bias correction operation, the correction operation portion 103 reads out information of the Vdc-Idc characteristics (or Vdc-VO characteristics) that t is stored in the characteristics information storing portion 105 and, based on this characteristics information, determines whether the charging bias after correction that is obtained as a result of the first bias correction operation, i.e. the charging bias Vdc (B) obtained in the aforementioned step S4, is at the first level or at the second level that is higher than the first level, taking the inflection point of the Vdc-Idc characteristics (or the Vdc-VO characteristics) as the decision boundary. More specifically, the correction operation portion 103 determines whether or not the charging bias Vdc(B) is a voltage value equal to or greater than the inflection starting voltage (step S5). When it is determined that the voltage value is not equal to or greater than the inflection starting voltage (NO at step S5), the process moves to the operation of step S8, described later, without changing the target current Idc(T) (without performing further correction of the charging bias). When it is determined that the voltage value is equal to or greater than the inflection starting voltage (YES at step S5), the correction operation portion 103 reads out the change information that is stored in the change information storing portion 106 and changes (sets) the value of the current target current Idc(T) to a new target current Idcα(T) that corresponds to the charging bias Vdc(B) based on the change information (step S6). Subsequently, using the target current Idcα(T), the correction operation portion 103 calculates the bias correction value using the above described formula (2) of (Idcα(T)−Idc(B))*k, calculates a new charging bias Vdc(C) by adding this calculated bias correction value to the charging bias Vdc(B), and outputs the information of this charging bias Vdc(C) to the charging bias applying portion 101 (step S7). In this case, Idc(B) is, for example, the value detected in step S7 by the charging current detecting portion 102 when the charging bias Vdc(B) is applied to the charging roller 41 by the charging bias applying portion 101.

Thus, bias correction is performed by the first bias correction operation so as to approach a charging bias that is obtained with the target current Idc(T), and bias correction is performed by the second bias correction operation that also takes into account the deterioration of the charging roller to thereby determine the final charging bias value for performing the actual image forming operation. As a result, it is possible to output an appropriate charging bias without the aging time until the image forming operation starts becoming long, even in a case in which the resistance value of the charging roller changes, and to output an appropriate charging bias also in the latter half of the life of the charging roller.

Thereafter, image formation processing (print operation) is executed for the print job as instructed in the above described step S1 (step S8). For example, if it is assumed that the print job is a job to print 100 sheets, and the determined charging bias is Vdc(C), the charging bias Vdc(C) is applied to the charging roller 41 for each sheet from 1 to 100, respectively, to perform printing (image formation) in order.

Although according to the present flowchart a configuration is adopted in which the charging bias Vdc(C) that is obtained by the second bias correction operation is used for printing from the first sheet at step S8, a configuration may also be adopted in which the first sheet is printed using the charging bias Vdc(B) that is obtained by the first bias correction operation, and the charging bias Vdc(C) is then reflected in the processing to print the second sheet and thereafter. The important point is that the configuration is one in which the target current Idc(T) is changed in accordance with the charging bias after the first bias correction operation and the corrected charging bias is then further corrected based on the changed target current Idc(T), and an arbitrary method or timing can be employed as the method or timing with which to reflect this further corrected charging bias in the actual printing (image formation processing).

Figure 8:
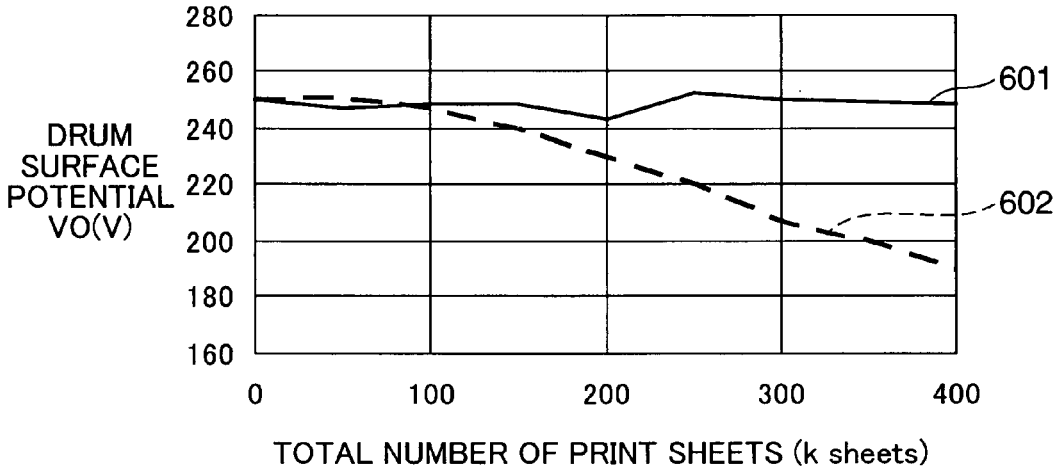
FIG. 8 is a graph diagram showing an example of changes in the surface potential of a photosensitive drum in a case in which charging bias correction is performed and a case in which charging bias correction is not performed.

In this connection, FIG. 8 is a view showing an example of changes in the surface potential of a photosensitive drum in a case in which charging bias correction is performed and a case in which charging bias correction is not performed according to the present embodiment. The vertical axis represents the surface potential VO(V) and the horizontal axis represents the total number of print sheets (unit: 1000 (k) sheets) in an endurance test. A surface potential change characteristic 601 in FIG. 6 illustrates the changes in surface potential in a case in which a second bias correction operation that changes the target current Idc(T) is performed after performing a first bias correction operation by a repetition operation using the above described formula (1) according to the present embodiment. Further, a surface potential change characteristic 602 illustrates the changes in surface potential in a case in which the second bias correction operation is not performed after performing the first bias correction operation, i.e. a case in which the target current Idc(T) value is fixed. According to FIG. 6, it is found that although for the surface potential change characteristic 602 the surface potential VO decreases significantly from around the start of the latter half of the life (endurance life), for the surface potential change characteristic 601 the surface potential is maintained at a substantially fixed level (indicates a favorable surface potential retention properties).

The image forming apparatus (printer 1) according to the present invention as described above comprises a charging bias applying portion 101 (bias applying portion) that applies a charging bias (Vdc) to the charging roller 41, a charging current detecting portion 102 (current detecting portion) that detects a charging current (Idc) when the charging bias is applied, a correction operation portion 103 (bias correcting portion) that performs correction of the charging bias, and a comparison information storing portion 104 (target information storing portion) that stores a target charging current value (target current Idc(T)) taken as a target that is a charging current value when the surface of a photosensitive member (photosensitive drum 3) is charged to a required surface potential, wherein the correction operation portion 103 performs a first bias correction operation that compares a charging current value (Idc(A)) that is detected by the charging current detecting portion 102 when a predetermined charging bias (charging bias Vdc(A) as an initial setting value) is applied by the charging bias applying portion 101 with a target charging current value that is stored in the comparison information storing portion 104 and corrects the above described predetermined charging bias based on the comparison result to obtain a new charging bias (Vdc(B)), and a second bias correction operation that determines whether the corrected charging bias (Vdc(B)) that is obtained as a result of the first bias correction operation is at a predetermined first level or at a second level that is higher than the first level, and when the corrected charging bias (Vdc(B)) is at the second level, changes the target charging current value in accordance with the corrected charging bias and corrects the corrected charging bias based on the thus-changed target charging current value to obtain a new charging bias (Vdc(C)).

Thus, since a first bias correction operation is performed that obtains a new charging bias by comparing a charging current value when a predetermined charging bias is applied with a target charging current value and then correcting the charging bias on the basis of the comparison result (without continuing execution of a convergence operation until a certain condition that should correct the charging bias is reached), even when the resistance value of the charging roller 41 changes, an appropriate charging bias can be output without the time until the start of an image forming operation becoming long. Further, a second bias correction operation is performed in which the first level is taken as a level for which there is a normal relationship between a charging current at which a required charging bias can be obtained and the charging bias, and the second level that is higher than the first level is taken as a level for which there is an abnormal relationship between the charging current and the charging bias owing to deterioration of the charging roller 41 or the like, it is determined whether the corrected charging bias (Vdc(B)) is at the first level or at the second level, and when the corrected charging bias is determined as being at the second level, the target charging current value is changed in accordance with the corrected charging bias and the corrected charging bias is then corrected on the basis of the changed target charging current value to obtain a new charging bias. It is therefore possible to output an appropriate charging bias that also takes into consideration the life of the charging roller, that is, to output an appropriate charging bias in the latter half of the life of the charging roller also.

Further, since the target charging current value is changed (changed from a target current Idc(T) to Idcα(T)) by the correction operation portion 103 so as to change in a stepwise manner in accordance with the corrected charging bias (Vdc (B)), it is easy to perform control (operations) when changing the target charging current value, and thus a second bias correction operation can be performed with good efficiency.

Furthermore, since the configuration is one in which the correction operation portion 103 determines which level a corrected charging bias is at among a first level and a second level (whether at the first level or at the second level) taking as a decision boundary a predetermined inflection point in a first bias characteristic (Vdc-Idc characteristics 201 or 202) having the relationship between a charging bias and a charging current or a second bias characteristic (Vdc-VO characteristic 401) having the relationship between a charging bias and a drum surface potential that are stored in the characteristics information storing portion 105 (characteristics information storing portion), and changes the target charging current value in accordance with the corrected charging bias when it is determined that the corrected charging bias is at the second level, more specifically, since information at inflection points with respect to the first bias characteristic or the second bias characteristic is used in determining whether the corrected charging bias is at the first level or the second level, it is possible to determine whether or not to change the target charging current value easily and accurately based on the relevant bias characteristic. Thus, the second bias correction operation can be performed efficiently and accurately.

Also, since a new charging bias (Vdc(C)) is determined in the second bias correction operation by the correction operation portion 103 by adding the bias correction value that is calculated using the above described formula (2) to the corrected charging bias (Vdc(B)), the second bias correction operation can be performed with good efficiency using a simple operational expression.

Further, since the photosensitive drum 3 consists of an a-Si drum with high durability, it is possible to provide the printer 1 in which, in addition to the performance of bias correction by the first and second bias correction operations, favorable image forming operations (stability) are maintained over a long period.

In this connection, various additions and modifications can be made to the configuration of the present invention as described above without departing from the scope and spirit of the present invention. For example, the printer 1 is not limited to a configuration that performs black and white printing as shown in FIG. 1, and may be configured to perform color printing (color printer).

This application is based on patent application No. 2006-180192 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. An image forming apparatus that charges a surface of a photosensitive member to a predetermined potential using a charging roller, comprising:

a bias applying portion that applies a charging bias to the charging roller;

a current detecting portion that detects a charging current when the charging bias is applied;

a bias correcting portion that carries out correction of the charging bias; and a target information storing portion that stores a target charging current value that is taken as a target, that is a charging current value when the surface of the photosensitive member is charged to a required surface potential; wherein, the bias correcting portion performs a first bias correction operation and a second bias correction operation, in which, the first bias correction operation is an operation that compares a charging current value that is detected by the current detecting portion when a predetermined charging bias is applied by the bias applying portion with a target charging current value that is stored in the target information storing portion, and determines a new charging bias by correcting the predetermined charging bias on the basis of the comparison result; and the second bias correction operation is an operation that determines whether a corrected charging bias that is obtained as a result of the first bias correction operation is at a predetermined first level or at a second level that is higher than the first level, and when the corrected charging bias is determined to be at the second level, changes the target charging current value in accordance with the corrected charging bias and obtains a new charging bias by correcting the corrected charging bias on the basis of the target charging current value that is changed, wherein the bias correcting portion determines a new charging bias in the second bias correction operation by adding to the corrected charging bias a bias correction value that is calculated using the following formula (a):

$$(Idc\alpha(T)-Idc(m))*k \quad (a)$$

wherein, $Idc\alpha(T)$ represents the target charging current value that is changed, $Idc(m)$ represents a charging current value that is detected by the current detecting portion when the corrected charging bias is applied by the bias applying portion, "k" is a correction coefficient, and the symbol "*" represents multiplication.

2. The image forming apparatus according to claim 1, wherein the bias correcting portion changes the target charging current value in a stepwise manner in accordance with the corrected charging bias.

3. The image forming apparatus according to claim 1, further comprising:

a characteristics information storing portion that stores a first bias characteristic having a relationship between the charging bias and the charging current or a second bias characteristic having a relationship between the charging bias and a surface potential of the photosensitive member;

wherein the bias correcting portion:

determines which level the corrected charging bias is at among the first level and the second level by taking as a decision boundary a predetermined inflection point in the first bias characteristic or the second bias characteristic, and changes a target charging current value in accordance with the corrected charging bias when it is determined that the corrected charging bias is at the second level.

4. The image forming apparatus according to claim 1 wherein the photosensitive member comprises amorphous silicon.

* * * * *